US010434638B1

(12) United States Patent
Tsai

(10) Patent No.: US 10,434,638 B1
(45) Date of Patent: Oct. 8, 2019

(54) TOOL BOX ASSEMBLY

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 5 days.

(21) Appl. No.: 15/957,904

(22) Filed: Apr. 19, 2018

(51) Int. Cl.
*B25H 3/02* (2006.01)
*B65D 21/02* (2006.01)

(52) U.S. Cl.
CPC ..... *B25H 3/023* (2013.01); *B25H 3/021* (2013.01); *B65D 21/023* (2013.01); *B65D 21/0223* (2013.01); *B65D 21/0228* (2013.01)

(58) Field of Classification Search
CPC ..... B65D 21/0222; B65D 21/0223; B65D 21/023; B25H 3/021; B25H 3/023
See application file for complete search history.

(56) References Cited

U.S. PATENT DOCUMENTS

2011/0168599 A1* 7/2011 Koenig ..... A45C 7/0045 206/509
2017/0121056 A1* 5/2017 Wang ..... B65D 21/0228
2019/0039781 A1* 2/2019 Kogel ..... B65D 21/0212

FOREIGN PATENT DOCUMENTS

DE 202014103695 U1 * 10/2014 ..... B25H 3/02

* cited by examiner

*Primary Examiner* — Mollie Impink

(57) ABSTRACT

A tool box assembly includes multiple tool boxes that are stacked together. Each tool box has a body, a cover and multiple connectors. The connectors are used to connect two tool boxes together. The tool box on the upper level includes blocks, insertion plates, engaging portions and hooks so as to be connected with the recessed areas, notches, rooms and slots of the cover of the tool box on the lower level. The connectors each have a ridge and a rail. The rail is slidably engaged with the groove of the cover, and the ridge is connected with the clip portion and block of the cover.

13 Claims, 13 Drawing Sheets

TOOL BOX ASSEMBLY

BACKGROUND OF THE INVENTION

1. Fields of the Invention

The present invention relates to a tool box assembly, and more particularly, to a tool box assembly comprising multiple boxes removably stacked with each other.

2. Descriptions of Related Art

The conventional tool box is disclosed in U.S. Pat. No. 6,082,539 and includes a base portion having an outside surface, having a first recess defined in said outside surface with said first recess having a bottom portion, and having a first rib extending from said bottom portion of said first recess. A cover has an upper surface and a lateral side having a second recess defined in the upper surface. The second recess has a bottom portion, and the second recess opens to the lateral side of the cover. The second recess communicates with the first recess of the base portion. A second rib extends from the bottom portion of the second recess. A locking member comprises a first part pivotally engaged with the first recess. A second part with the second part having an outside surface and an inside surface. The second part is pivotally connected to the first part. The second part has an engagement portion proportioned to be capable of engagement with the first rib of a second identical tool box. The first recess has two sides and the two sides of the first recess have notches defined therein. The first part of the locking member has two rods extending from two sides thereof so as to be received in said two notches.

However, when the two boxes are stacked together, the first engaging means of the box on the bottom is engaged with the first rib of the top box, and this is not stable for maintaining the stacked boxes. When the first engaging means is engaged with the first rib, a portion of the combination of the first engaging means and the first rib is exposed, and the first rib can be easily separated from the first engaging means by impact. When stacking one box onto another, the lever on the cover of the bottom box has to be pivoted to separate the first engaging means from the second rib, and then the first engaging means is engaged with the first rib. Then the box can be stacked on the bottom box. There are too many steps involved. When opening the cover from the box, multiple locking members have to be opened one by one to separate the first engaging means from the second ribs, which is not convenient for the users. Besides, only the top most box can be opened, and the lower boxes cannot be opened.

The present invention intends to provide a tool box assembly that is designed to eliminate the drawbacks mentioned above.

SUMMARY OF THE INVENTION

The present invention relates to a tool box assembly and comprises multiple tool boxes that are stacked together. Each tool box has a body, a cover and multiple connectors. The connectors are used to connect two tool boxes together. The tool box on the upper level includes blocks, insertion plates, engaging portions and hooks so as to be connected with the recessed areas, notches, rooms and slots of the cover of the tool box on the lower level. The connectors each have a ridge and a rail. The rail is slidably engaged with the groove of the cover, and the ridge is connected with the clip portion and block of the cover.

When the connectors of the tool box on the lower level are connected to the blocks of the tool box on the upper level, the insertion plates and hooks on the tool box on the upper level do not disengaged from the notches and slots of the tool box on the lower level. The cover is secured to the body of the tool box, so that the tool box on the upper level is secured and not movable.

When the connectors of the tool box on the lower level are separated from the blocks of the tool box on the upper level, the insertion plates on the tool box on the upper level are partially restricted. The cover of the tool box on the lower level can be opened, while the tool box on the upper level cannot move relative to the tool box on the lower level. When connectors are separated from the blocks and the insertion plates, the tool box on the upper level can be separated from the tool box on the lower level.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
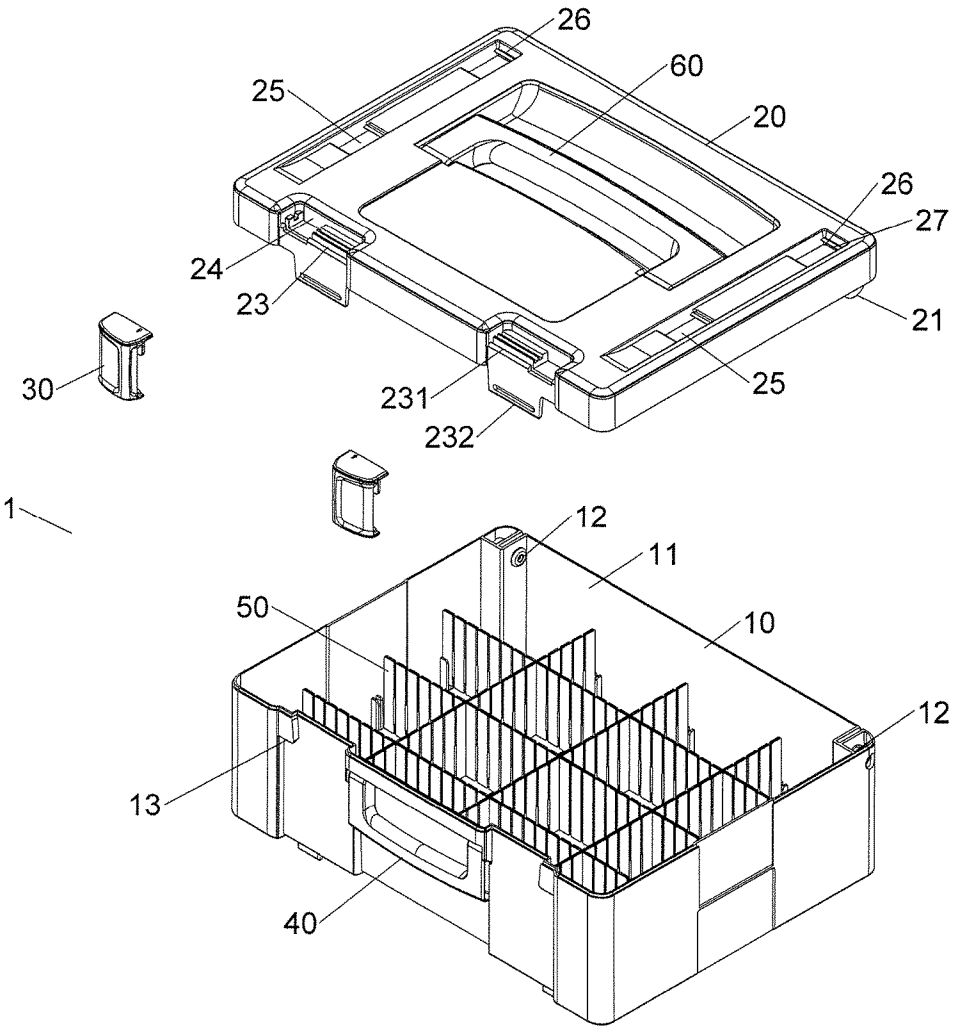
FIG. 1 is an exploded view of the tool box assembly of the present invention.
Figure 2:
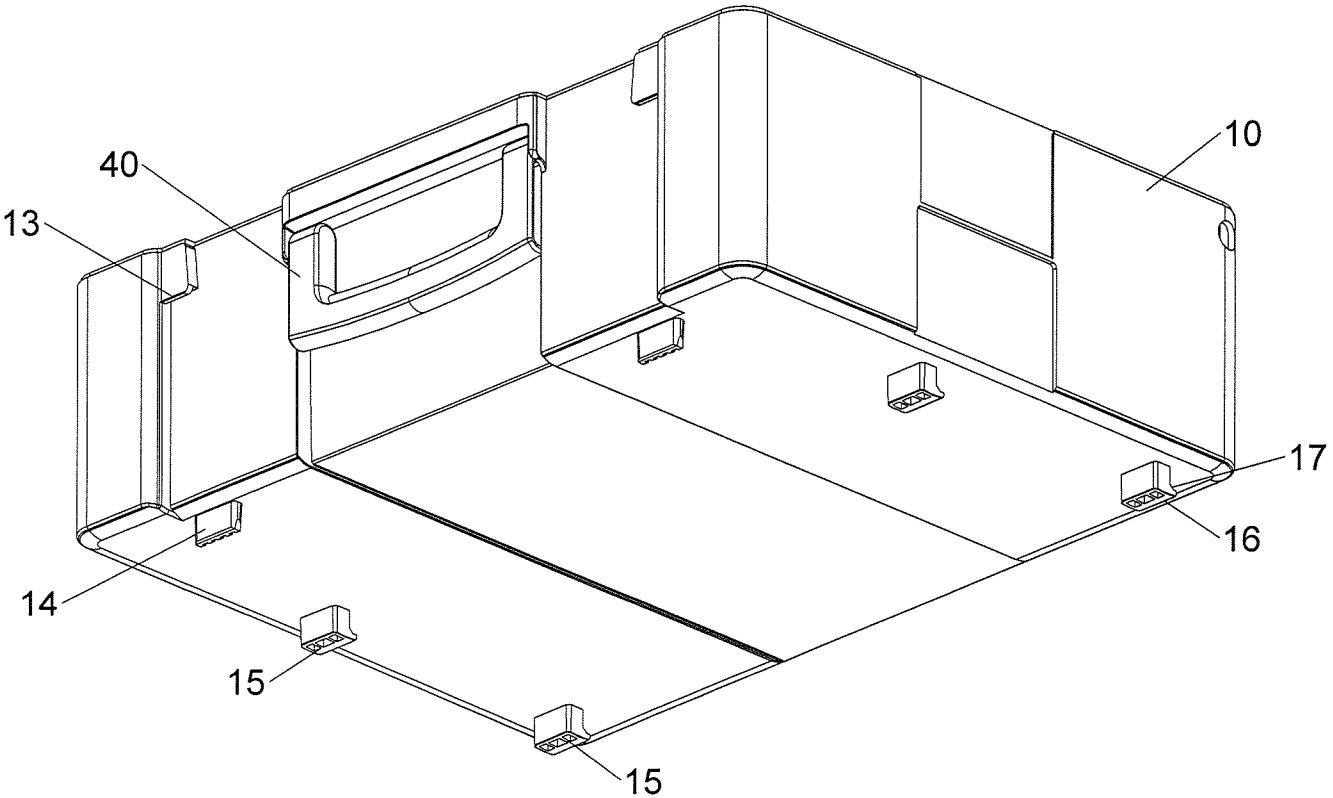
FIG. 2 shows one of the tool boxes of the tool box assembly of the present invention, wherein the tool box is arranged to be upside down.
Figure 3:
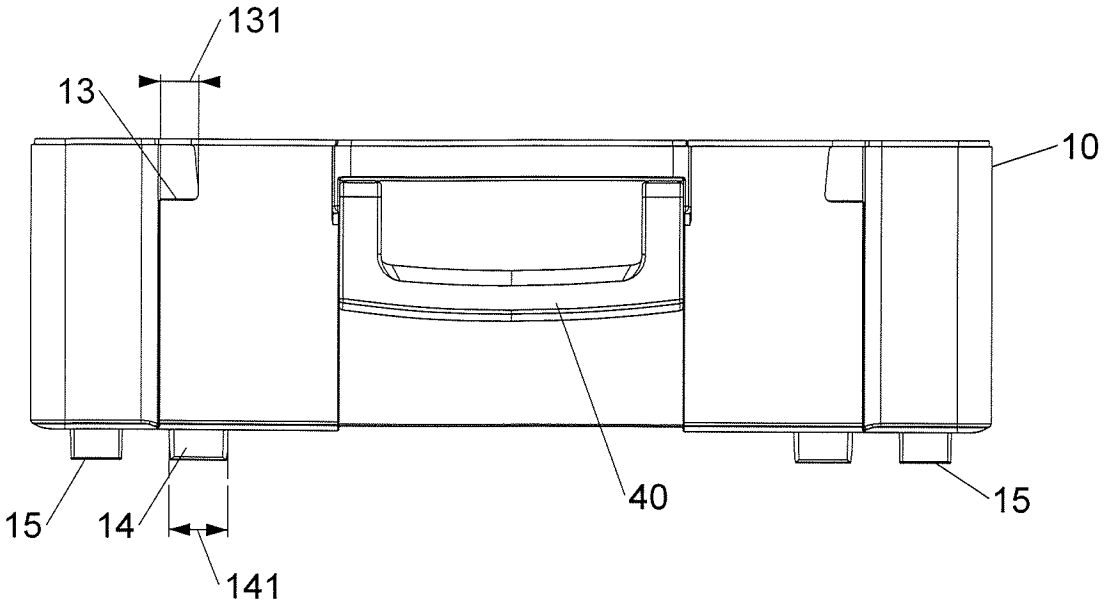
FIG. 3 is a front view of one of the tool boxes of the tool box assembly of the present invention.
Figure 4:
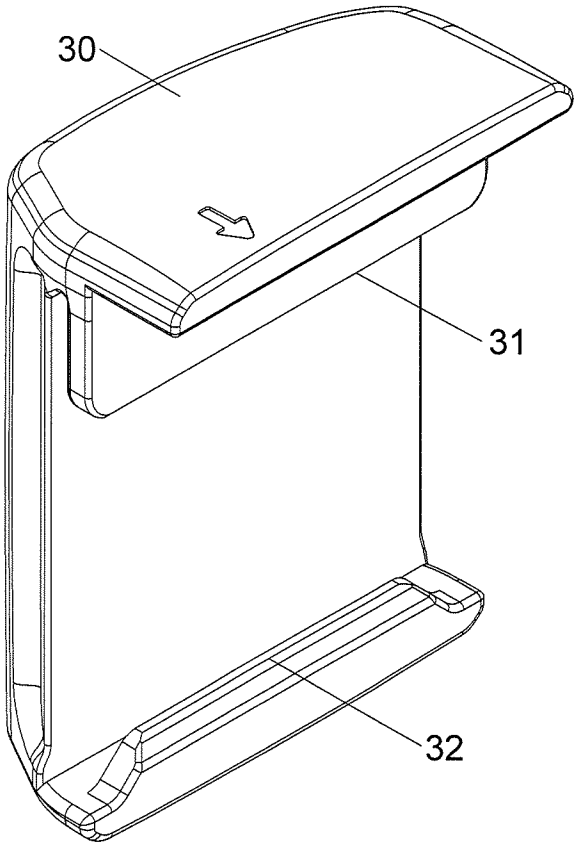
FIG. 4 shows the connector of the tool box assembly of the present invention.
Figure 5:
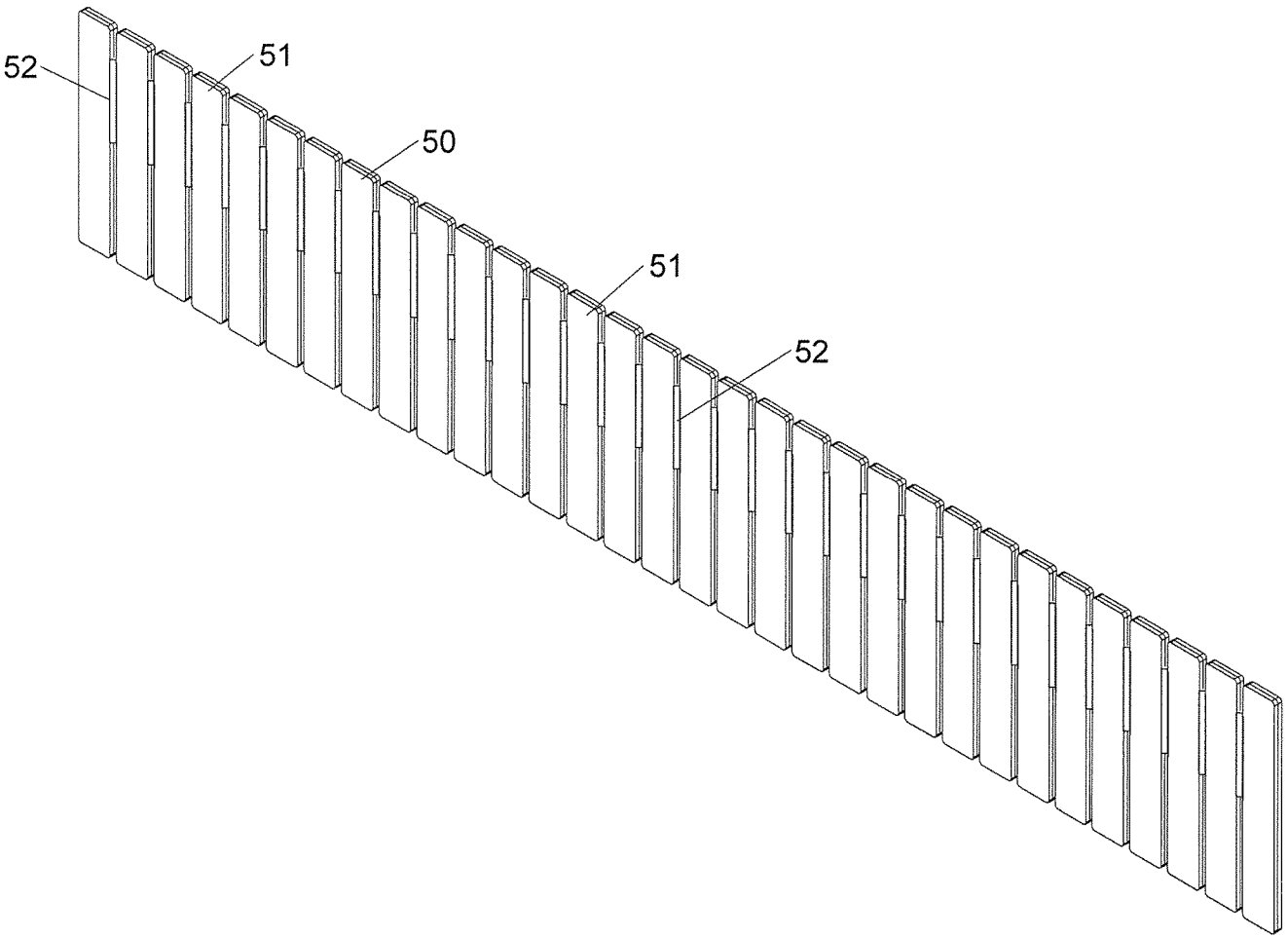
FIG. 5 shows the separation member of the tool box assembly of the present invention.
Figure 6:
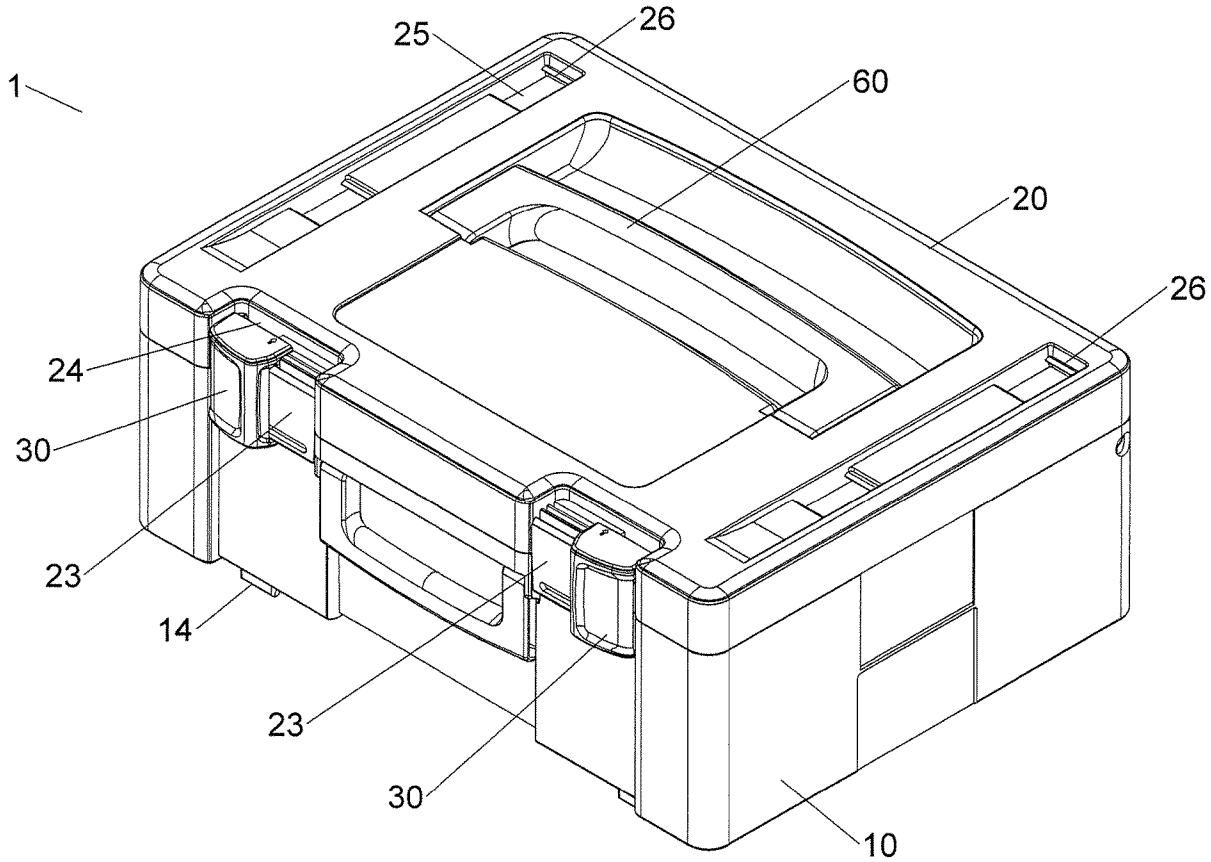
FIG. 6 shows one of the tool boxes of the tool box assembly of the present invention.
Figure 7:
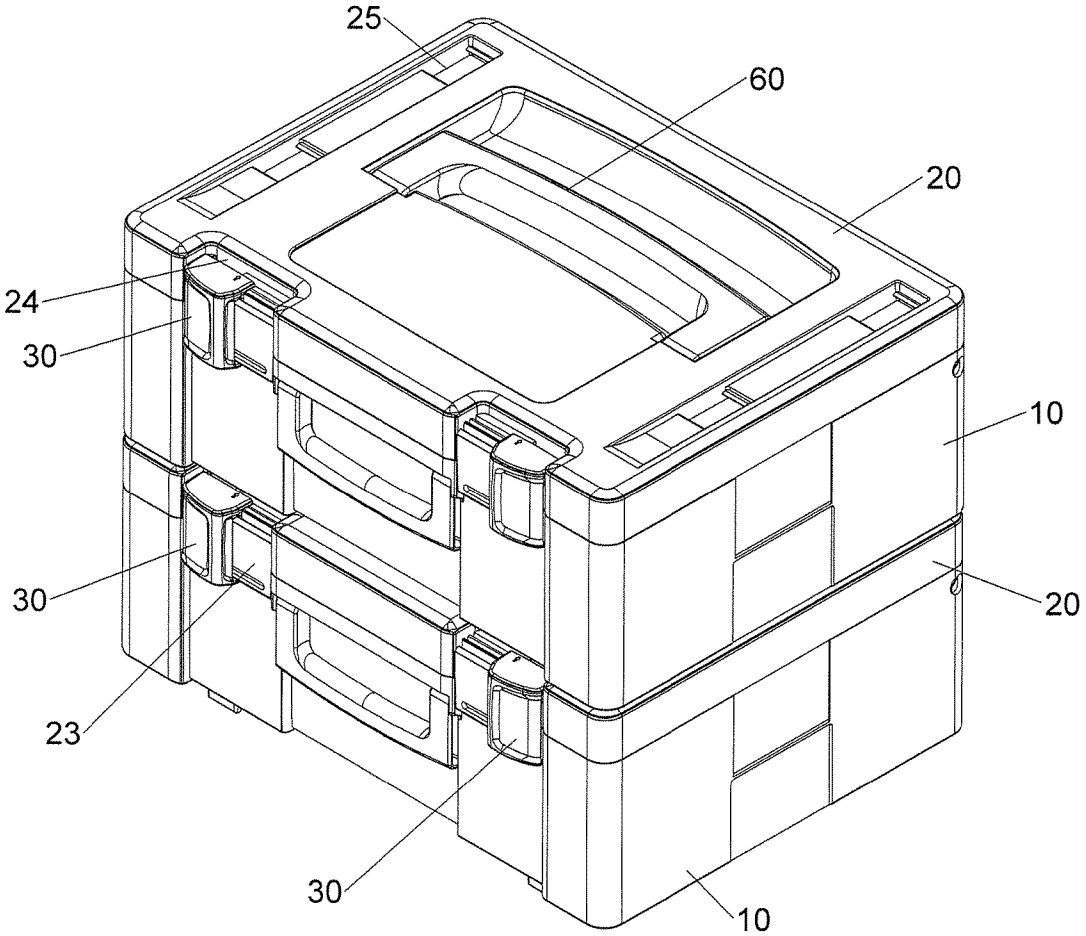
FIG. 7 shows the tool box assembly of the present invention.
Figure 11:
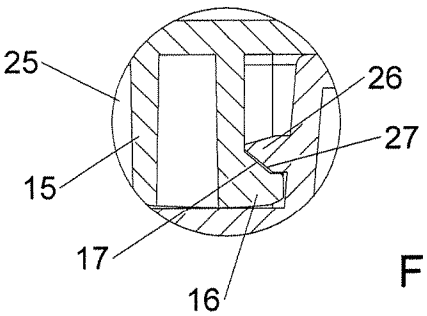
FIG. 11 is an enlarged view of the circled B of FIG. 9.
Figure 9:
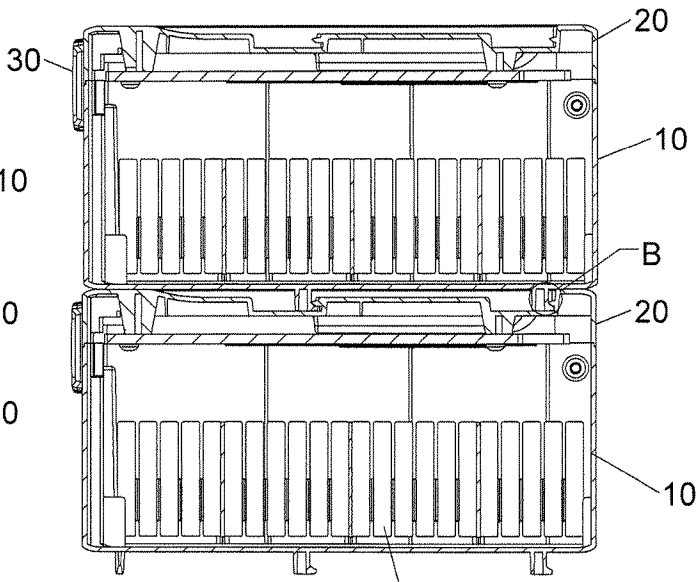
FIG. 9 is a cross sectional view, taken along line 9-9 in FIG. 8.
Figure 10:
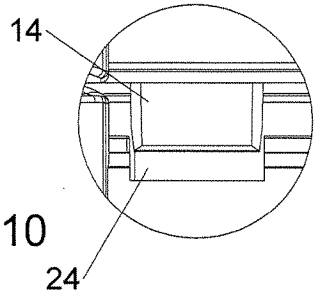
FIG. 10 is an enlarged view of the circled A of FIG. 8.
Figure 8:
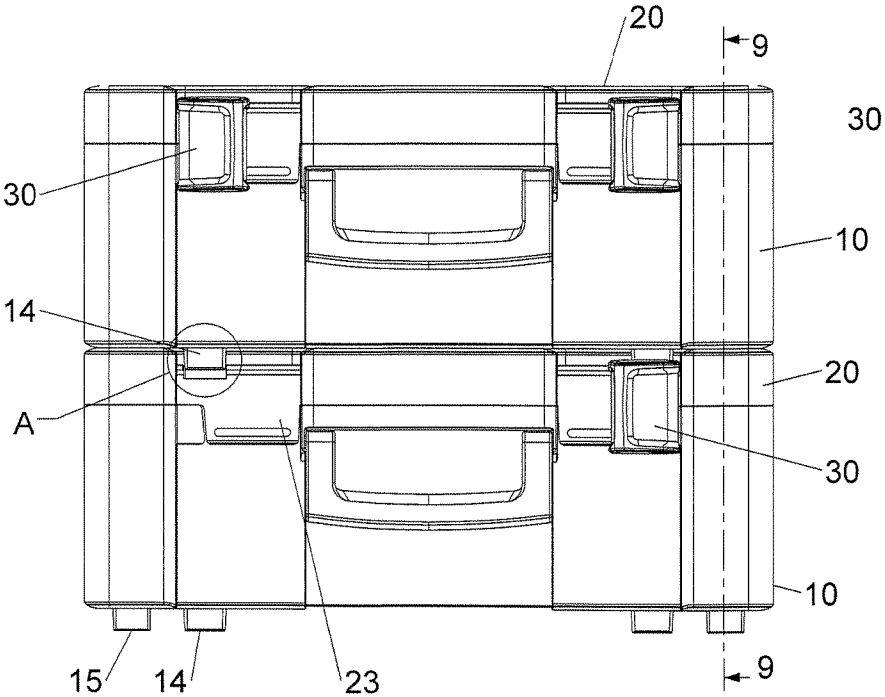
FIG. 8 shows the front view of the tool box assembly of the present invention.

Referring to FIGS. 1 to 6, the tool box assembly of the present invention comprises multiple tool boxes 1. Each tool box 1 includes a body 10, a cover 20, two connectors 30, a lateral handle 40, multiple separation members 50 and a top handle 60. The nod 10 has a front end and a rear end, and the cover 20 has its rear end pivotably connected to the rear end of the body 10. The body 10 has a space 11 defined therein so as to receive tools. The two connectors 30 are two trapezoidal blocks and located on the front end of the body 10. Four engaging portions 15 respectively extend from the four corners of the underside of the body 10, and two insertion plates 14 extend from the underside of the body 10. The insertion plates 14 are located corresponding to the two blocks 13. Each engaging portion 15 has a hook 16 formed at its distal end thereof. The width 141 of each insertion plate 14 is larger than the width 131 of each block 13. The hook 16 includes an inclined face 17.

Each cover 20 has two recessed areas 23 defined in the front end thereof, and the recessed areas 23 are located corresponding to the blocks 13 and the insertion plates 14. Each of the recessed areas 23 has a clip portion 232 on the lower end thereof, and a groove 231 and a notch 24 defined in the inner bottom thereof. Each cover 20 has multiple rooms 25 defined in the top thereof so as to allow the engaging portions 15 of the tool box 1 on its top to move. Each room 25 has a slot 26 defined in the inner bottom thereof such that the hook 16 of the tool box located on its top to be engaged therewith. The slot 26 includes an inclined guide face 27 along which the inclined face 17 may move. When the cover 20 is pivotably connected to the body 10 corresponding thereto by the pivotal portions 21, 12, and the cover 20 is mounted to the body 10, the clip portion 232 is engaged with the block 13 corresponding thereto and exposed beyond the cover 20. Specifically, each of the connectors 30 has a rail 321 and a ridge 32. The rail 321 is slidably engaged with the groove 231 corresponding thereto, and the ridge 32 is engaged with the clip portion 232 and the block 13 corresponding thereto.

As shown in FIGS. 7 to 11, when the two tool boxes 1 are stacked with each other, the insertion plates 14, the engaging portions 15 and the hooks 16 of the tool box 1 located on the upper level are respectively engaged with the notches 24, the rooms 25 and the slots 26 of the tool box 1 located at the lower level. Specifically, when each connector 30 of the tool box 1 on the lower level is slid along the grooves 231 to a first position and engaged with the block 13 by its ridge 32, and the insertion plates 14 and the hooks 16 of the tool box 1 on the upper level are restricted by the connectors 30 and the slots 26 of the tool box 1 on the lower level and cannot move.

Figure 15:
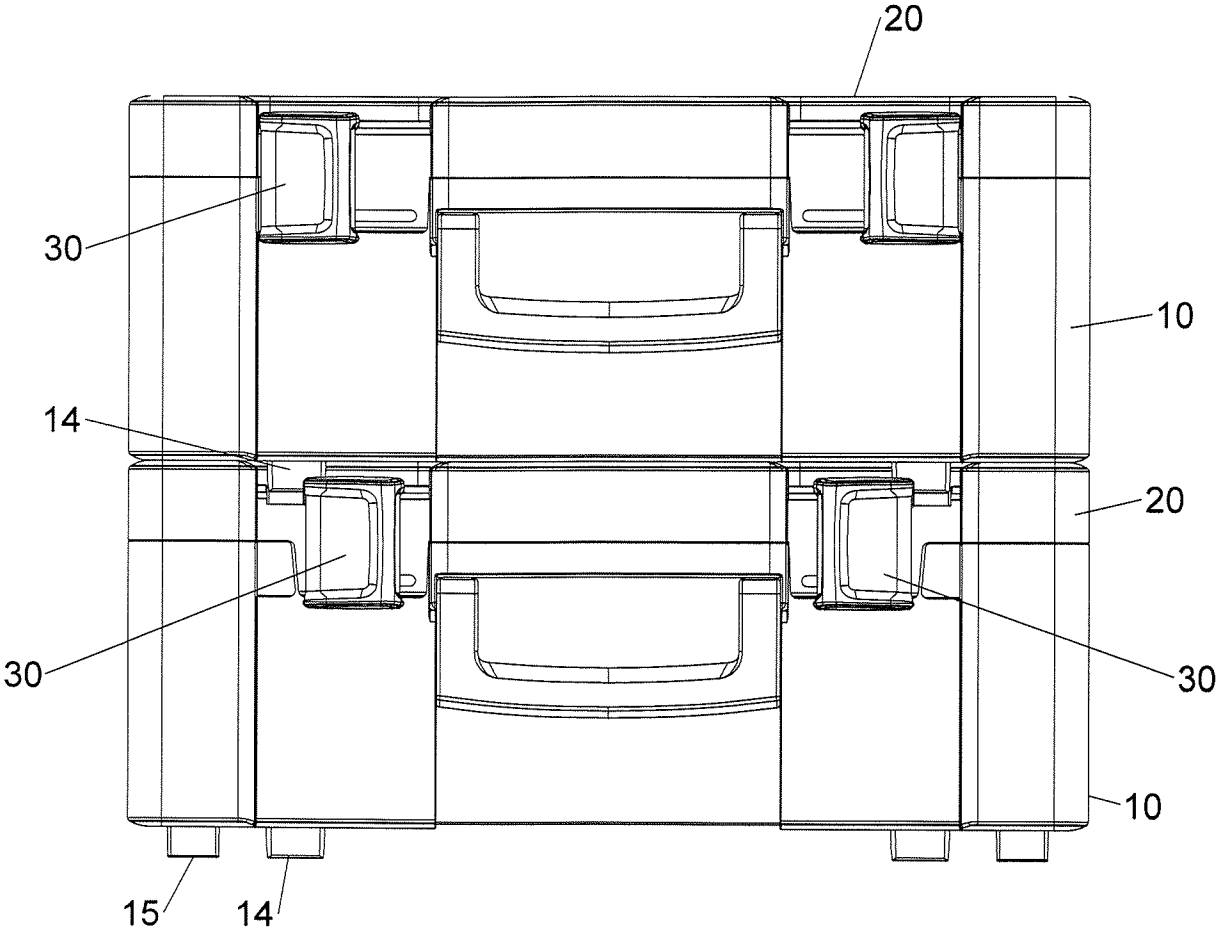
FIG. 15 is a front view of the fifth operative status of the tool box assembly of the present invention.
Figure 16:
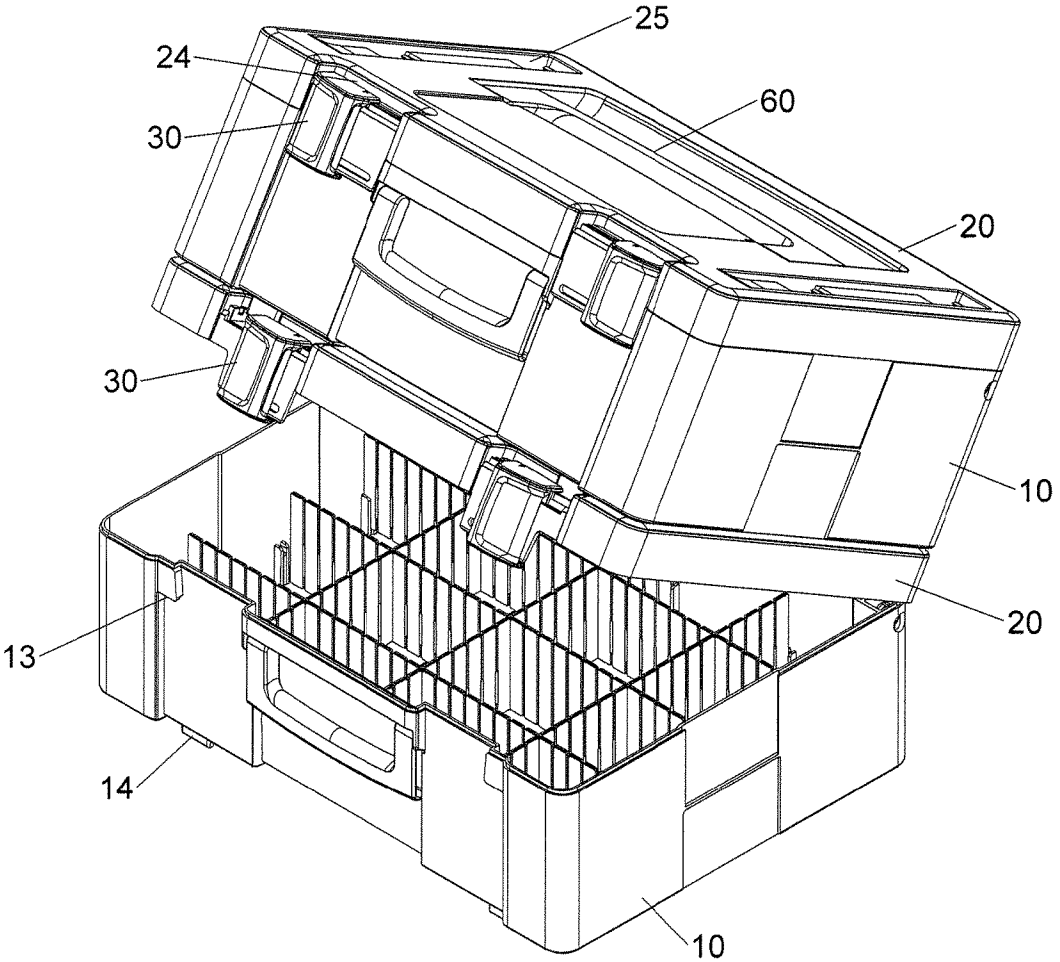
FIG. 16 shows the sixth operative status of the tool box assembly of the present invention.

As shown in FIGS. 15 and 16, when the connectors 30 of the tool box 1 on the lower level is slid along the grooves 231 to a second position and disengaged from the blocks 13, because the width 141 of each insertion plate 14 is larger than the width 131 of each block 13, the insertion plates 14 of the tool box 1 on the upper level is restricted by the connectors 30 of the tool box 1 on the lower level and cannot move toward the front end thereof.

Figure 12:
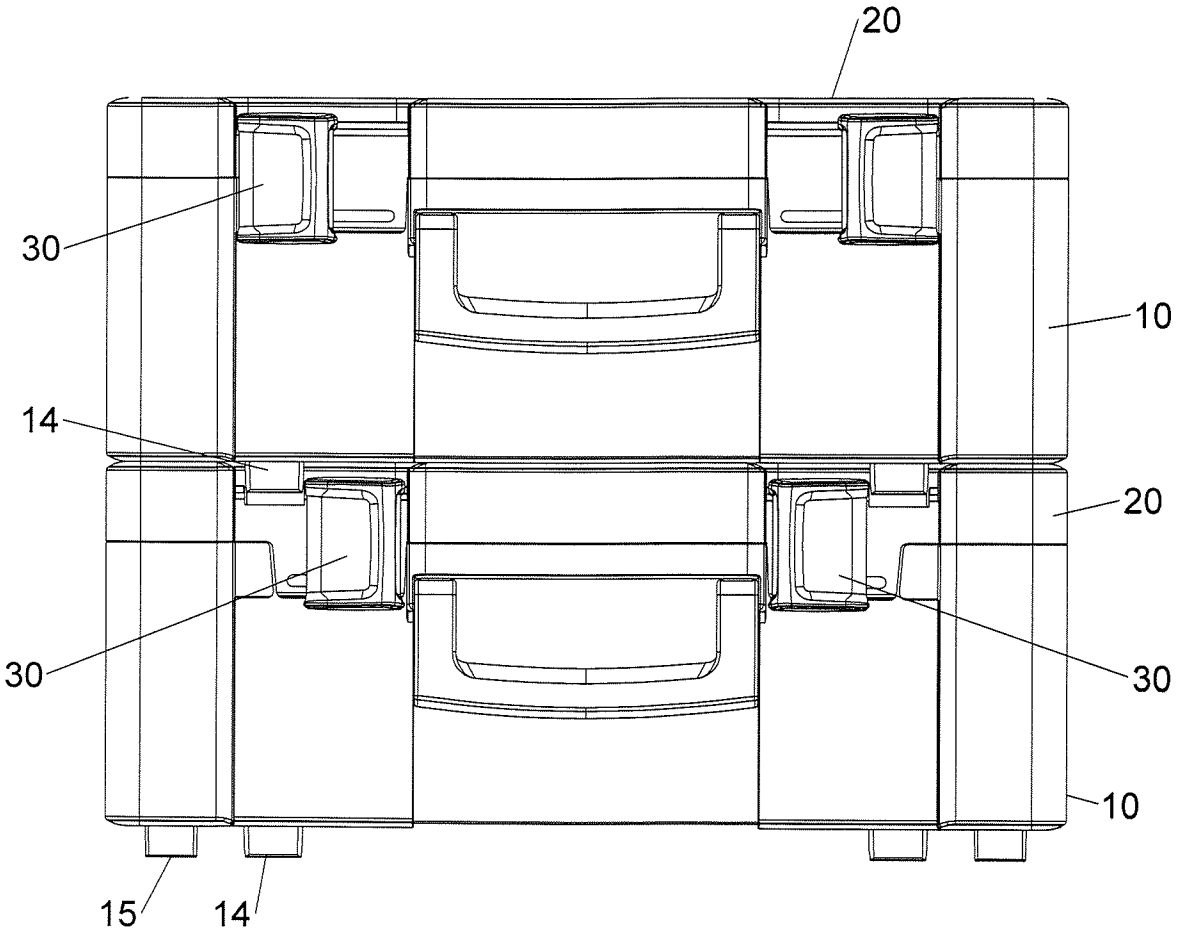
FIG. 12 is a front view of the second operative status of the tool box assembly of the present invention.
Figure 13:
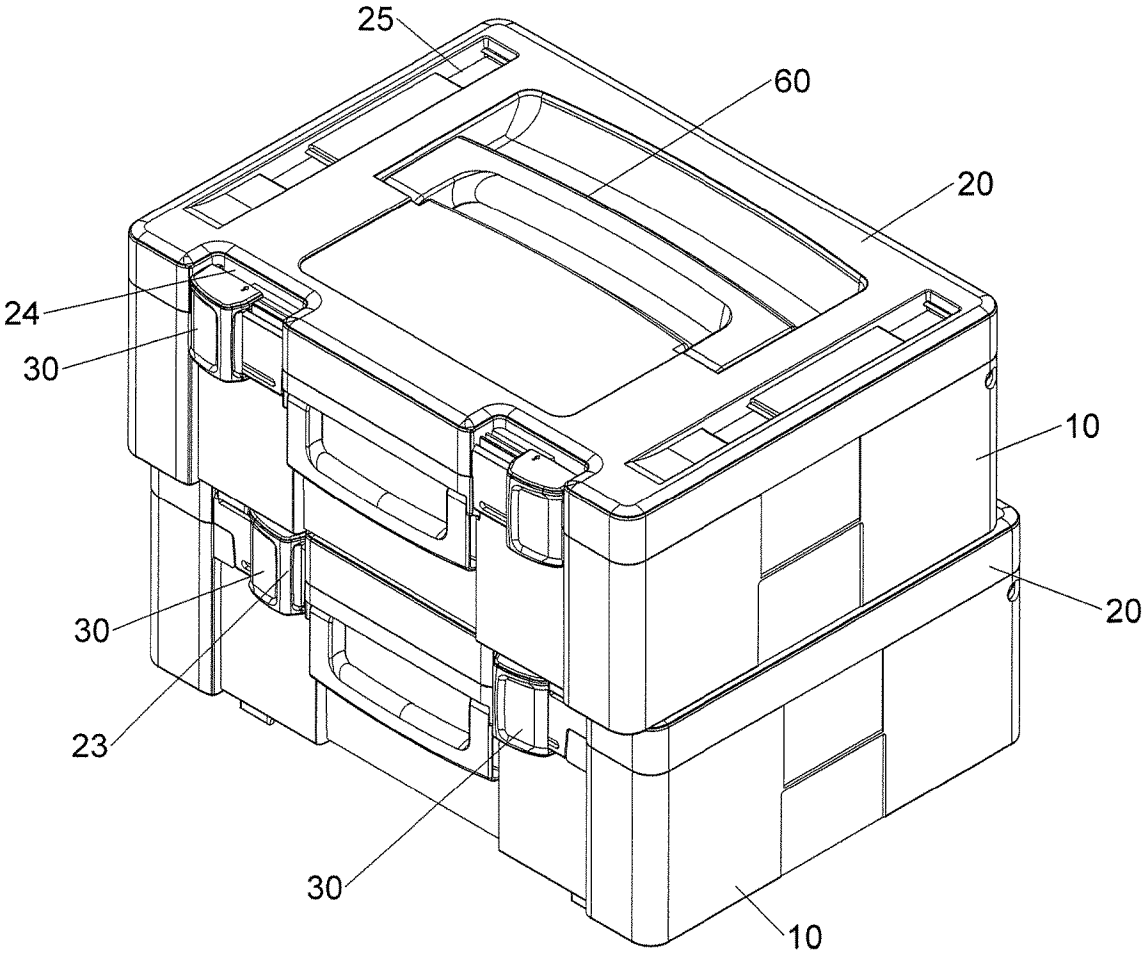
FIG. 13 shows the third operative status of the tool box assembly of the present invention.
Figure 14:
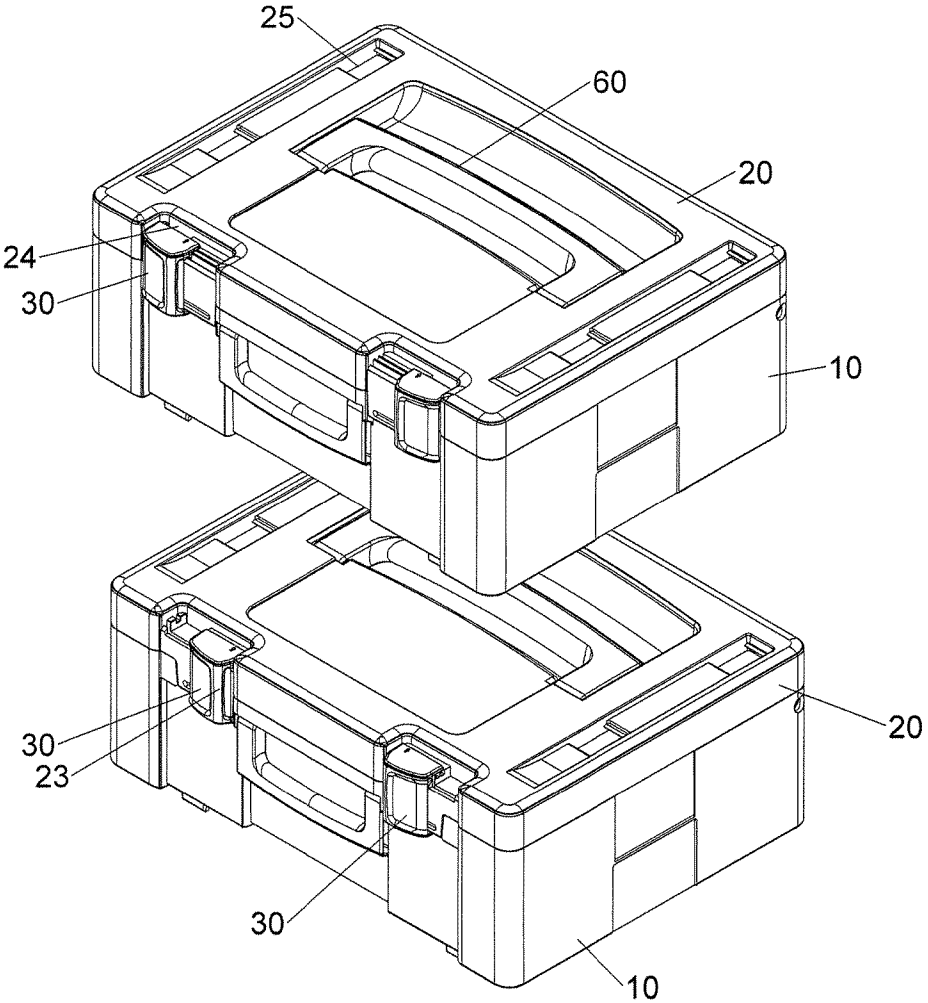
FIG. 14 shows the fourth operative status of the tool box assembly of the present invention.

As shown in FIGS. 12 and 13, when the connectors 30 of the tool box 1 on the lower level is slid along the grooves 231 to a third position and disengaged from the blocks 13, and the insertion plates 14 of the tool box 1 on the upper level are not restricted by the connectors 30 of the tool box 1 on the lower level, the tool box 1 on the upper level can be movable toward the front end and upward relative to the tool box 1 on the lower level. While the insertion plates 14 and the engaging portions 15 of the tool box 1 on the upper level are respectively moved to front section of the notches 24 and the rooms 25 of the tool box 1 on the lower level. The inclined faces 17 of the tool box 1 on the upper level move along the guide faces 27 of the tool box 1 on the lower level, so that the hooks 16 of the tool box 1 on the upper level are separated from the slots 26 of the tool box 1 on the lower level, and the two tool boxes 1 can be separated from each other.

The lateral handle 40 is located between the two blocks 13 of the tool box 1. The top handle 60 is located on the top of the cover 20 and located between the rooms 25.

The multiple separation member 50 are inserted into the space 11 in a crossing form to form multiple compartments which are adapted to receive tools. Each separation member 50 includes multiple boards 51 connected to each other, and breakable portion 52 is formed between the boards 51. The breakable portion 52 can be broken or cut.

In another embodiment, the width 141 of each insertion plate 14 is larger than the width 131 of each block 13, the connectors 30 may have the operative statuses at the first, second and third positions. When the width 141 of each insertion plate 14 is equal to the width 131 of each block 13, the connectors 30 may have the operative statuses at the first and second positions. When the width 141 of each insertion plate 14 is smaller than the width 131 of each block 13, the connectors 30 may have the operative statuses at the first, second and third positions. However, when the connectors 30 are at the second position, the tool box 1 on the upper level can be separated from the tool box 1 on the lower level, and each cover 20 is secured to the body 10 by the engagement of the connectors 30 and the blocks 13.

The advantages of the present invention are that when the two tool boxes 1 are stacked to each other, the engagement between the connectors 30 and the blocks 13 also restrict the insertion plates 14 from disengaging from the notches 24.

When the connectors 30 do not restrict the insertion plates 14, the two stacked tool boxes 1 can be moved relative to each other to disengage the hooks 16 from the slots 26.

When the connectors 30 are located at the first position and engaged with the blocks 13 to restrict the insertion plates 14, the two stacked tool boxes 1 cannot be moved relatively.

When the connectors 30 are located at the second position, and the width 141 of each insertion plate 14 is larger than the width 131 of each block 13, the blocks 13 restrict the insertion plates 14 so that the two stacked tool boxes 1 cannot be separated.

When the connectors 30 are located at the third position, and the insertion plates 14 are not restricted by the blocks 13, the insertion plates 14 and the engaging portions 15 are respectively movable relative to the notches 24 and the rooms 25. The hooks 16 are separated from the slots 26, and the two stacked tool boxes 1 can be separated.

When multiple tool boxes 1 are stacked to each other, the connectors 30 have three operative statuses relative to the tool boxes 1, so that the features of use of the present invention is expanded.

As shown in FIG. 12, when the connectors 30 are located at the third position, and the cover 20 of the tool box 1 of the lower level is opened upward, the hooks 16 of the tool box 1 on the upper level are hooked to the slots 26 of the tool box 1 on the lower level, and the tool box 1 on the upper level is still connected to the cover 20 of the tool box 1 on the lower level. Only the insertion plates 14 of the tool box 1 on the upper level are not restricted by the connectors 30.

While we have shown and described the embodiment in accordance with the present invention, it should be clear to those skilled in the art that further embodiments may be made without departing from the scope of the present invention.

What is claimed is:

1. A tool box assembly comprising:

two tool boxes and each tool box having a body and a cover, a rear end of the cover of each tool box pivotably connected to a rear end of the body of each tool box, at least one connector connecting the body and the cover of each tool box;

at least one block formed on a front end of the body of each tool box, the body of each tool box having at least one insertion plate and multiple engaging portions respectively extending from an underside of the body of each tool box, each at least one insertion plate located corresponding to each at least one block, each engaging portion having a hook formed at a distal end of each engaging portion;

the cover of each tool box having at least one recessed area defined in a front end of the cover of each tool box, each at least one recessed area located corresponding to each at least one block and each at least one insertion plate, each at least one recessed area having a clip portion, each at least one recessed area having a groove and a notch defined in an inner bottom of each at least one recessed area, the cover of each tool box having multiple rooms defined in a top of the cover, each room having a slot defined in an inner bottom of each room, when the cover is mounted to the body corresponding thereto, the clip portion of each at least one recessed area is engaged with each at least one block corresponding thereto and exposed beyond the cover correspondingly, and each at least one connector having a rail and a ridge, the rail of each at least one connector slidably engaged with the groove of each at least one recessed area corresponding thereto, the ridge of each at least one connector engaged with the clip portion of each at least one recessed area and each at least one block corresponding thereto, wherein the two tool boxes are stacked with each other, the at least one insertion plate, the multiple engaging portions and the hook of the tool box located on an upper level are respectively engaged with the notch of the at least one recessed area, the multiple rooms and the slot of the tool box located at a lower level.

2. The tool box assembly as claimed in claim 1, wherein each at least one block is a trapezoidal block, each at least one insertion plate is a rectangular plate.

3. The tool box assembly as claimed in claim 1, wherein a width of each at least one insertion plate is larger than a width of each at least one block.

4. The tool box assembly as claimed in claim 1, wherein the hook of each engaging portion includes an inclined face and the slot of each room includes a guide face which is an inclined face.

5. The tool box assembly as claimed in claim 1, wherein when the tool box on the upper level is located to protrude beyond the front end of the tool box on the lower level, each at least one insertion plate of the tool box on the upper level is correspondingly located at a front section of the notch of each at least one recessed area of the tool box on the lower level, the engaging portions of the tool box on the upper level are located corresponding to the rooms of the tool box on the lower level, the hook on each engaging portions of the tool box on the upper level is separated from the slot of each room of the cover of the tool box on the lower level, when the tool box on the upper level is moved to a position that is matched with the tool box on the lower level, each at least one insertion plate of the tool box on the upper level is located at a rear section of the notch of each at least one recessed area of the tool box on the lower level, the hook on each engaging portions of the tool box on the upper level is engaged with the slot of each room of the cover of the tool box on the lower level.

6. The tool box assembly as claimed in claim 5, wherein when the at least one connector of the tool box on the lower level is sliding along the grooves to a first position and engaged with the at least one block correspondingly, the at least one insertion plate of the tool box on the upper level is restricted by the at least one connector of the tool box on the lower level and cannot move.

7. The tool box assembly as claimed in claim 5, wherein when the at least one connector of the tool box on the lower level is sliding along the grooves to a second position and disengaged from the at least one block correspondingly, a width of the at least one insertion plate is larger than a width of the at least one block, the at least one insertion plate of the tool box on the upper level is restricted by the at least one connector of the tool box on the lower level and cannot move toward the front end of the tool box on the lower level.

8. The tool box assembly as claimed in claim 5, wherein when the at least one connector of the tool box on the lower level is sliding along the grooves to a third position and disengaged from the at least one block correspondingly, the at least one insertion plate of the tool box on the upper level is not restricted by the at least one connector of the tool box on the lower level, the tool box on the upper level is movable toward the front end and upward of the tool box on the upper level relative to the tool box on the lower level, the hook is disengaged from the slot correspondingly.

9. The tool box assembly as claimed in claim 1, wherein the number of the at least one block is two and a lateral handle is located between the two blocks of each tool box.

10. The tool box assembly as claimed in claim 1, wherein multiple separation members are inserted into a space in a crossing form to form multiple compartments which are adapted to receive tools, each separation member includes multiple boards connected to each other, a breakable portion is formed between the boards.

11. The tool box assembly as claimed in claim 1, wherein the cover of each tool box has a top handle on a top thereof.

12. The tool box assembly as claimed in claim 1, wherein a width of each at least one insertion plate is equal to a width of each at least one block.

13. The tool box assembly as claimed in claim 1, wherein a width of each at least one insertion plate is smaller than a width of each at least one block.

* * * * *